US007708603B1

(12) United States Patent
Little

(10) Patent No.: US 7,708,603 B1
(45) Date of Patent: May 4, 2010

(54) ELECTRICAL CONNECTOR WITH IMPROVED CROSSTALK FEATURES

(75) Inventor: Terrance Little, York, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/321,090

(22) Filed: Jan. 12, 2009

(51) Int. Cl.
*H01R 24/00* (2006.01)

(52) U.S. Cl. ..... 439/676; 439/941

(58) Field of Classification Search ..... 439/676, 439/941, 620.11

See application file for complete search history.

(56) References Cited

U.S. PATENT DOCUMENTS

| | | | | |
|---|---|---|---|---|
| 5,547,405 | A | 8/1996 | Pinny | |
| 6,290,506 | B1 * | 9/2001 | Milner | 439/3 |
| 6,409,547 | B1 * | 6/2002 | Reede | 439/676 |
| 6,447,341 | B1 * | 9/2002 | Hyland | 439/676 |
| 6,488,544 | B1 * | 12/2002 | Hyland | 439/676 |
| 6,981,883 | B2 | 1/2006 | Raistrick | |
| 7,575,483 | B1 * | 8/2009 | Zhang | 439/676 |
| 2006/0104821 | A1 * | 5/2006 | Hall | 416/244 R |
| 2008/0132123 | A1 * | 6/2008 | Milette et al. | 439/676 |
| 2008/0311797 | A1 * | 12/2008 | Aekins | 439/676 |
| 2009/0075523 | A1 * | 3/2009 | Caveney et al. | 439/676 |
| 2009/0191740 | A1 * | 7/2009 | Aekins | 439/218 |
| 2009/0227151 | A1 * | 9/2009 | Caveney | 439/676 |

* cited by examiner

*Primary Examiner*—Renee Luebke
*Assistant Examiner*—Larisa Tsukerman
(74) *Attorney, Agent, or Firm*—Ming Chieh Chang; Wei Te Chung; Andrew C. Cheng

(57) ABSTRACT

An electrical connector (100) includes a number of conductive contacts (21-28), a first capacitive plate (31) and an insulator (40) fixing the number of conductive contacts (21-28) and the capacitive plate (31). The number of conductive contacts further include a first pair of conductive contacts (21, 22) to form a first signal channel and a second pair of conductive contacts (23, 26) to form a second signal channel. The first capacitive plate (31) is electrically connected with one conductive contact (23) of the second pair. The first capacitive plate (31) is disposed closer to one conductive contact (21) of the first pair than the conductive contact (23) which the first capacitive plate (31) is electrically connected to. The insulator (40) is partially hollowed out between the first capacitive plate (31) and the corresponding conductive contact (21) of the first pair to improve the crosstalk between the first and the second signal channels.

11 Claims, 5 Drawing Sheets

ELECTRICAL CONNECTOR WITH IMPROVED CROSSTALK FEATURES

BACKGROUND OF THE INVENTION

1. Field of the Invention

The present invention generally relates to an electrical connector, and more particularly to an electrical connector with improved crosstalk features.

2. Description of Related Art

U.S. Pat. No. 5,547,405 issued to ITT Industry on Aug. 20, 1996 discloses a low cost modular jack for minimizing crosstalk. The modular jack comprises pairs of electrical contacts. One electrical contact of one pair is electrically connected with a capacitive plate disposed closer to one electrical contact of another pair so that crosstalk is minimized.

SUMMARY OF THE INVENTION

An object of the present invention is to provide an electrical connector with improved crosstalk features.

In order to achieve the object set forth, an electrical connector for mating with a complementary electrical connector comprising a plurality of conductive contacts, a first capacitive plate and an insulator fixing the plurality of conductive contacts and the first capacitive plate. The plurality of conductive contacts further comprise a first pair of conductive contacts to form a first signal channel and a second pair of conductive contacts to form a second signal channel. The first capacitive plate is electrically connected to one conductive contact of the second pair. The first capacitive plate is disposed closer to one conductive contact of the first pair than the conductive contact which the first capacitive plate is connected to. The insulator is partially hollowed out between the first capacitive plate and the corresponding conductive contact of the first pair to improve the crosstalk between the first and the second signal channels.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
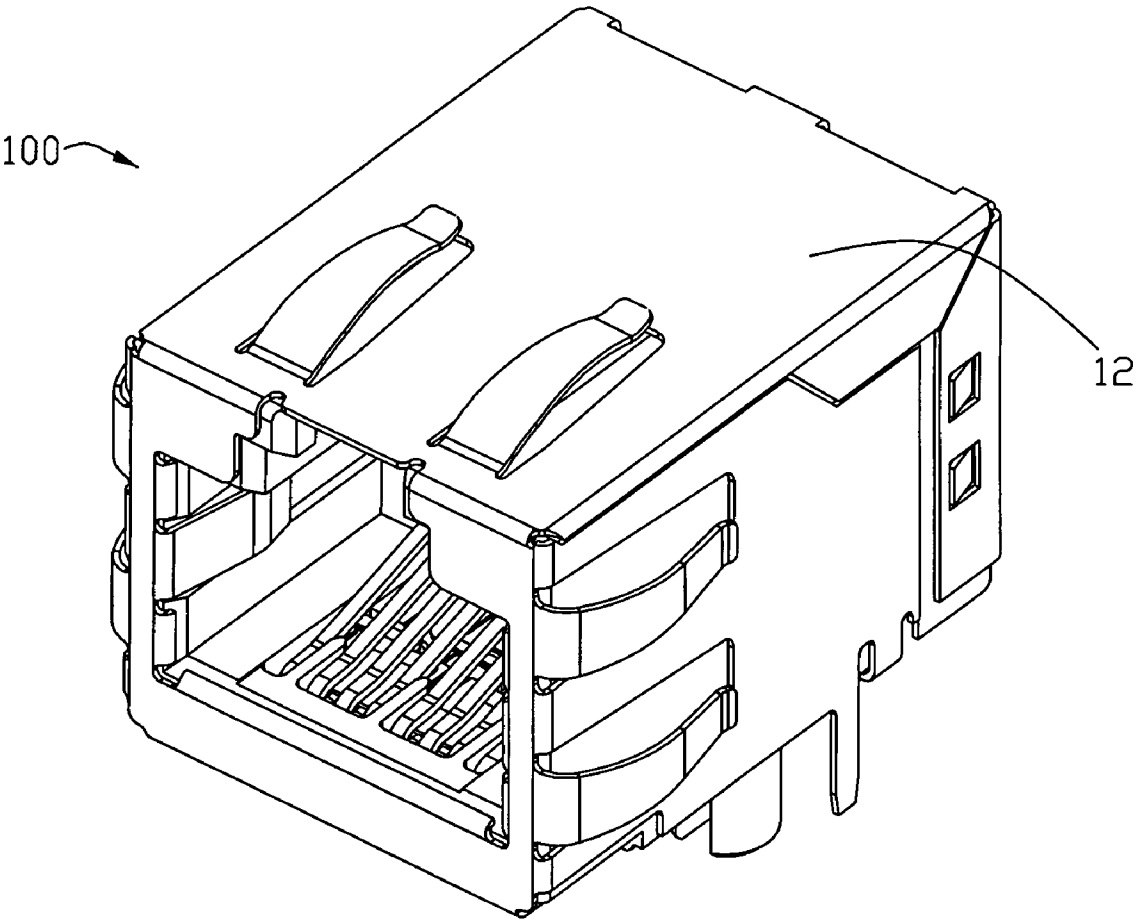
FIG. 1 is a perspective view of an electrical connector in accordance with the present invention.
Figure 2:
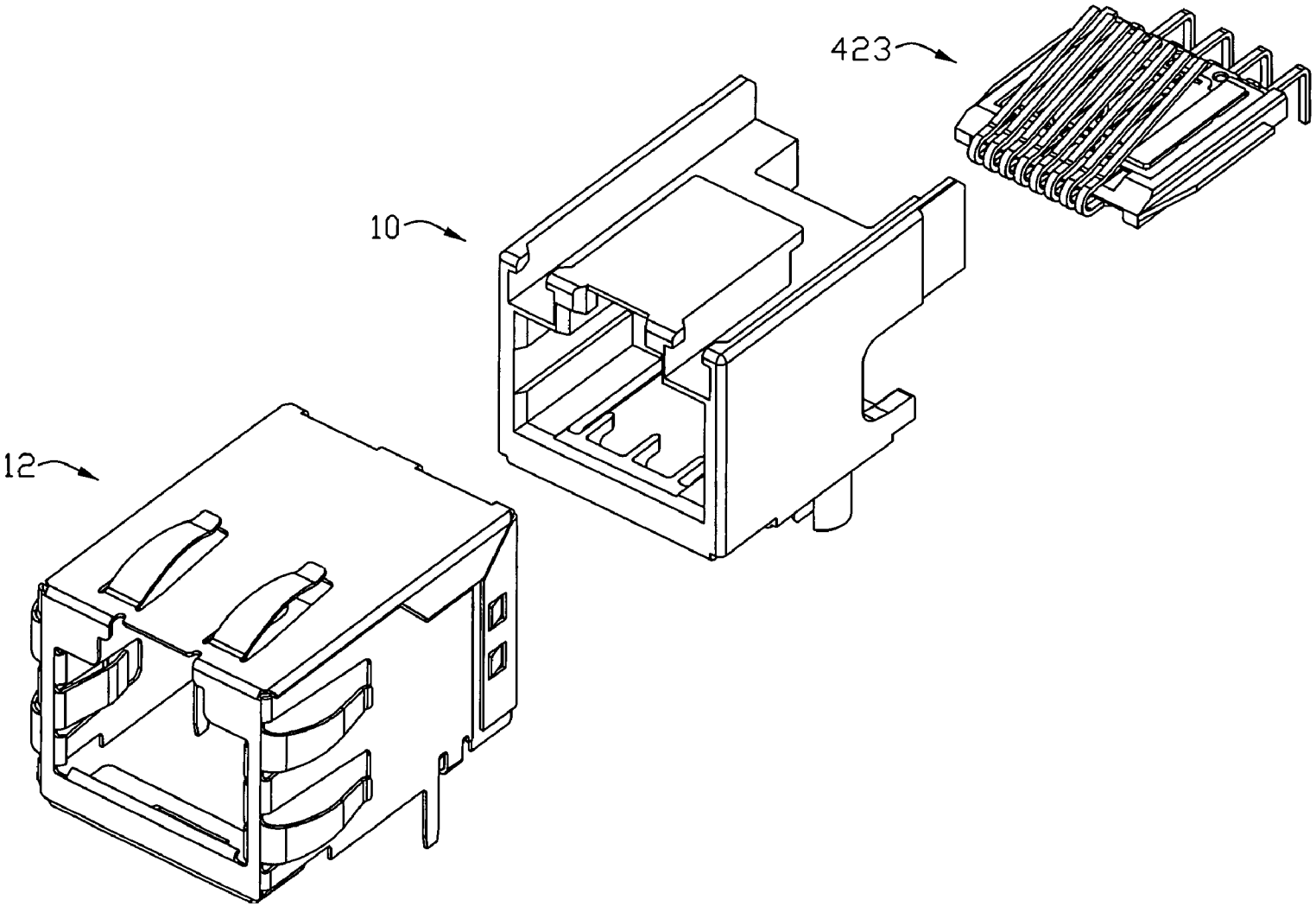
FIG. 2 is an exploded view of the electrical connector shown in FIG. 1.

Referring to FIGS. 1 and 2, an electrical connector 100 according to the present invention is designed to meet CAT 5E Specification. The electrical connector 100 is used for mating with a complementary electrical connector (not shown), such as an RJ 45 plug. The electrical connector 100 comprises eight conductive contacts 20 and four capacitive plates 31, 33, 36, 38, an insulator 40 fixing the conductive contacts 20 and the capacitive plates 31, 33, 36, 38 together to form a contact module 423, an insulated housing 10 receiving the contact module 423.

Figure 3:
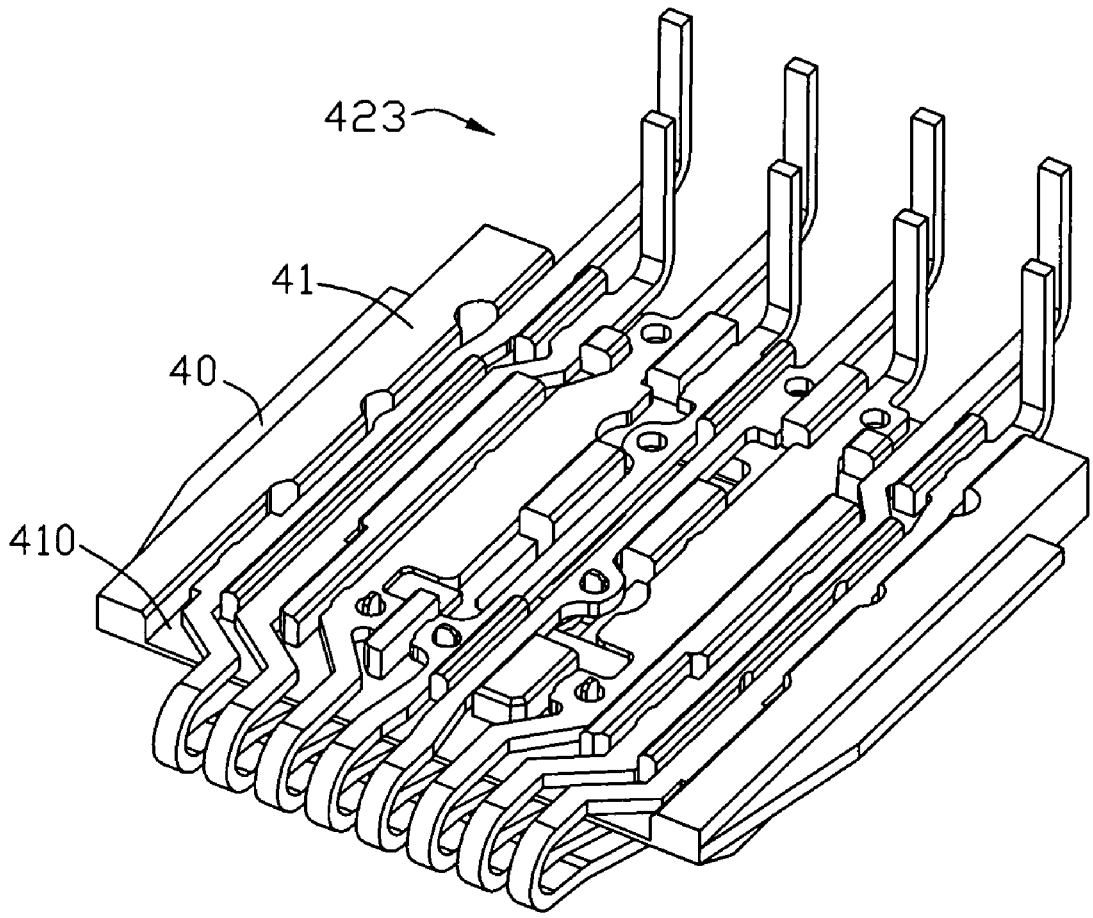
FIG. 3 is a perspective view of a contact module shown in FIG. 2 from another aspect.
Figure 4:
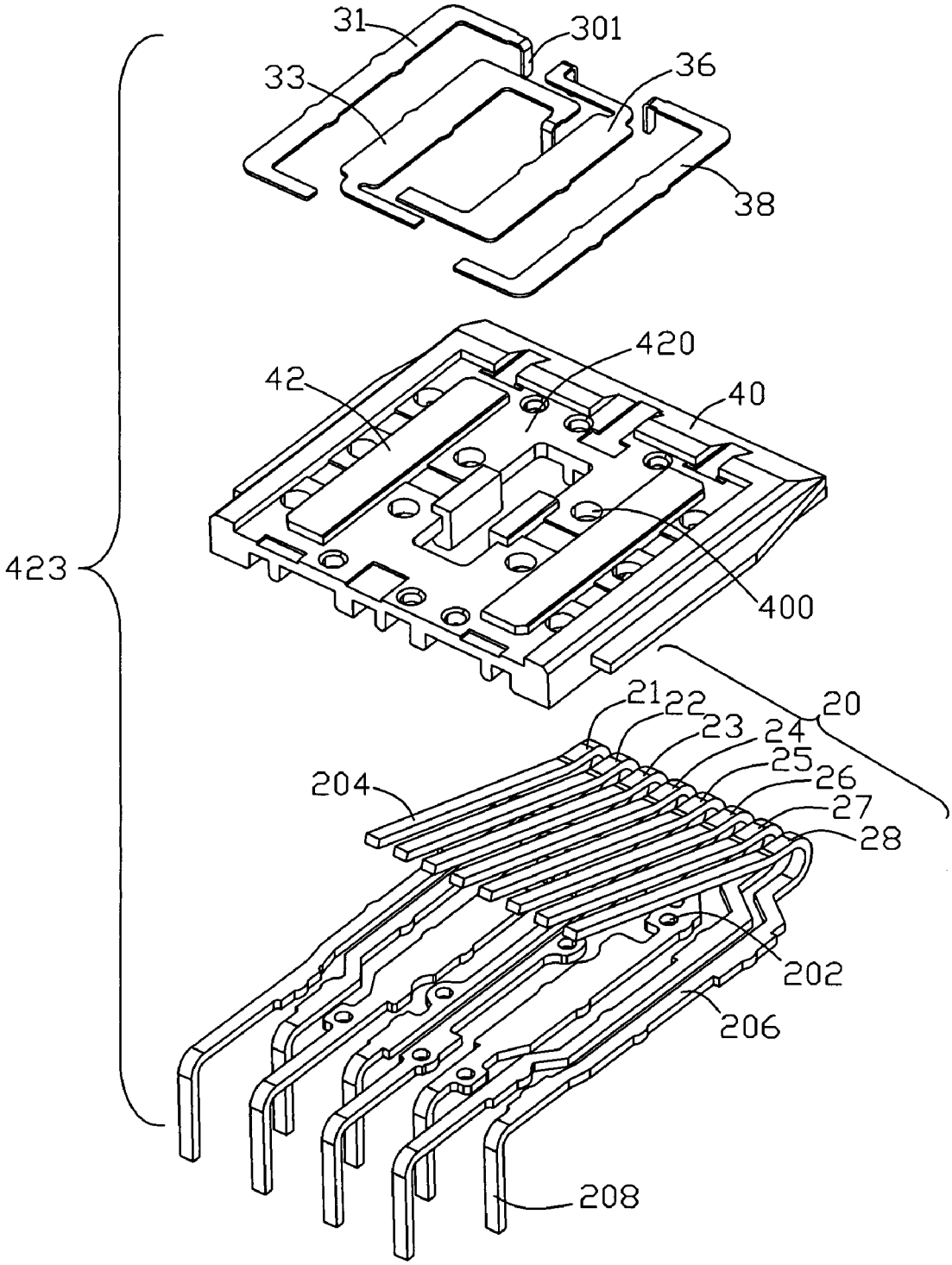
FIG. 4 is an exploded view of the contact module shown in FIG. 3.
Figure 5:
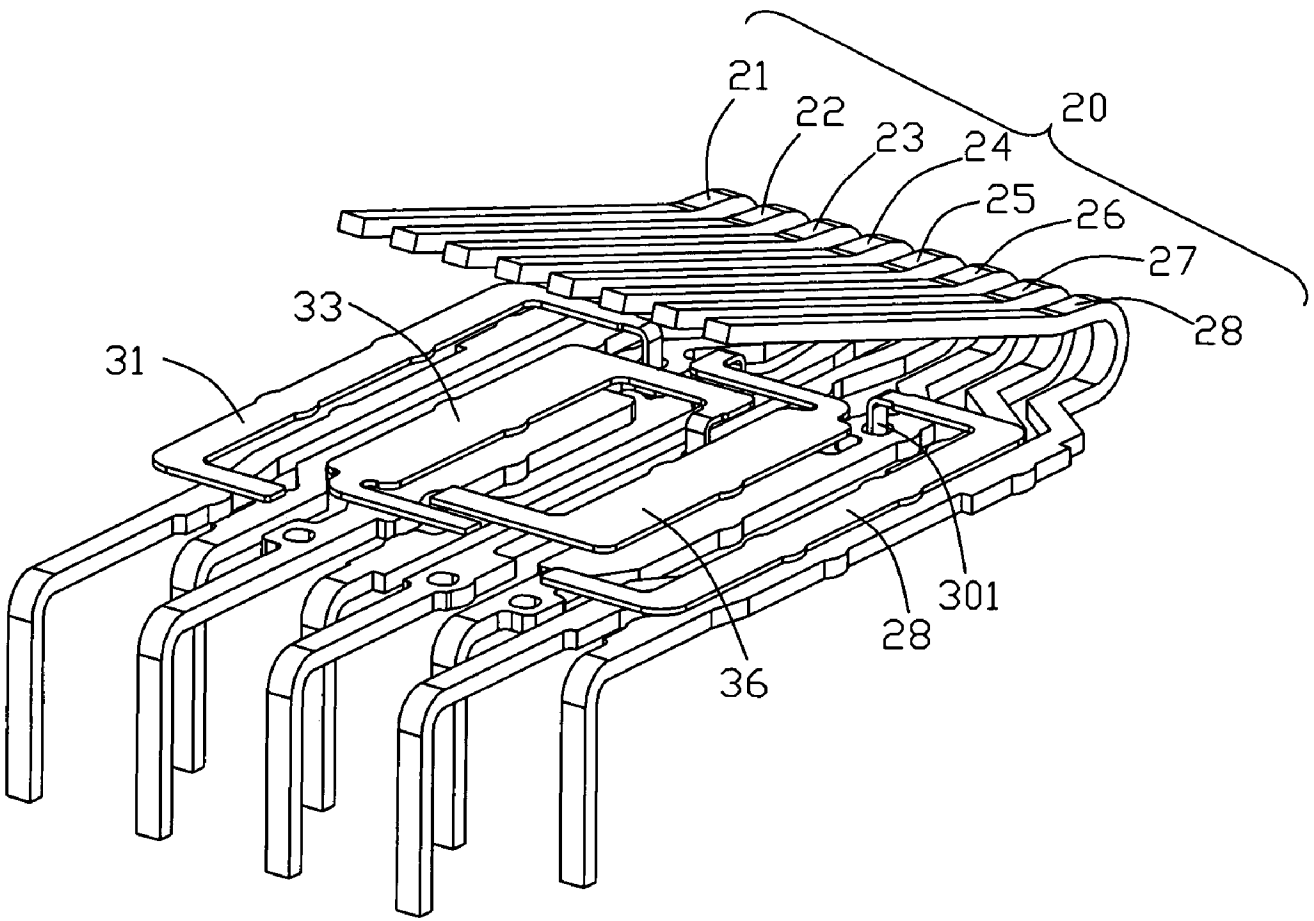
FIG. 5 is a perspective view of the capacitive plates and the conductive contacts in place.

Referring to FIGS. 3-5 the conductive contacts 20 are arrayed in a first line and are named in turn the first to eighth conductive contacts 21-28. The first and the second conductive contacts 21, 22 compose a first pair of conductive contacts, the third and the sixth 23, 26 compose a second pair, the forth and the fifth 24, 25 compose a third pair, and the seventh and the eight 27, 28 composing a forth pair. Each pair of conductive contacts 21-28 is used to form a signal channels for transferring signal pairs to the complementary connector. The first to the eighth conductive contacts 21-28 are stamped from a flat metal plate (not shown) and each forms a fastening portion 206 for fastening the conductive contact to the insulator 40, a contacting portion 204 for contacting the complementary connector and a tail portion 208 for mounting on a printed circuit board (not shown). Each fastening portions 206 of the third to the sixth conductive contacts 23-26 defines a through hole 202.

The four capacitive plates 31, 33, 36, 38 are lined in a second line parallel to the first line and are named in turn the first to the forth capacitive plates 31, 33, 36, 38. The first to forth capacitive plates 31, 33, 36, 38 are stamped from another metal plate (not shown) and each formed with a pin 301 bent from a plane the capacitive plates 31, 33, 36, 38 lies on. When the conductive contacts 21-28 and the capacitive plate 31, 33, 36, 38 are assembled to the insulator 40 to form a contact module 423, the pins 301 fit into the through the holes 202 to establish electrical connection, thereby the first capacitive plate 31 is electrically connected to the third conductive contact 23, the second capacitive plate 33 is electrically connected to the fifth conductive contact 25, the third capacitive plate 36 is electrically connected to the forth conductive contact 24, the forth capacitive plate 38 is electrically connected to the sixth conductive contact 26. In order to achieve the required crosstalk, each of the capacitive plates 31, 33, 36, 38 is respectively aligned to the fastening portion 206 of each the conductive contacts 21, 23, 26, 28, so that each of the capacitive plates 31, 33, 36, 38 is disposed closer to corresponding conductive contacts 21, 23, 26, 28 than the conductive contact 23-26 which the capacitive plate 31, 33, 36, 38 is electrically connected with. That is to say that the first capacitive plate 31 is closer to the first conductive contact 21 than the third conductive contact 23, the second capacitive plate 33 is closer to the third contact 23 than the fifth conductive contact 25, the third capacitive plate 36 is closer to the six contact 26 than the forth conductive contact 24, and the forth capacitive plate 38 disposed closer to the eighth conductive contact 28 than the sixth conductive contact 26.

The insulator 40 defines a first and a second outer side faces 41, 42 opposite to each other and a plurality of slots 410, 420 in the first and the second outer side faces 41,42. The eight conductive contacts 21-28 are respectively received in the slots 410 in the first outer side face 41 and the four capacitive plates 31, 33, 36, 38 are respectively received in the slots 420 in the second outer side face 42. The insulator 40 further defines a plurality of holes 400 respectively aligning with the four capacitive plates 31, 33, 36, 38 in a direction perpendicular to the first outer side face 41. The holes 400 extend from the first outer side face 41 to the second outer side face 42, so that the insulator 40 are partially hollowed out and air is filled therein between respective capacitive plate 31, 33, 36, 38 and corresponding conductive contacts 21, 23, 26, 28. In principle, the air filled portions are not necessary to be defined in shape of through holes, they can be any concaves hollowed out to control the impedance between the capacitive plates 31, 33, 36, 38 and corresponding conductive contacts 21, 23, 26, 28 and thereby to control the crosstalk between the signal channels thereof.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

I claim:

1. An electrical connector for mating with a complementary electrical connector comprising:

a plurality of conductive contacts for contacting the complementary electrical connector, the plurality of conductive contacts further comprising a first pair of conductive contacts to form a first signal channel and a second pair of conductive contacts to form a second signal channel;

a first capacitive plate electrically connected to one conductive contact of the second pair, said capacitive plate being disposed closer to one conductive contact of the first pair than the conductive contact which the first capacitive plate is connected to; and an insulator fixing the plurality of conductive contacts and the capacitive plate;

wherein said insulator is partially hollowed out between the first capacitive plate and the corresponding conductive contact of the first pair to improve the crosstalk between the first and the second signal channels.

2. The electrical connector according to claim 1, wherein the insulator defines a first and a second outer side faces opposite to each other and a plurality of slots therein for respectively receiving the conductive contacts in the first outer side face and the first capacitive plate in the second outer side face.

3. The electrical connector according to claim 2, wherein the insulator defines a plurality of holes extending from the first outer side face to the second outer side face so that the insulator is hollowed out and air fills therein.

4. The electrical connector according to claim 1, wherein the plurality of conductive contacts further comprise a third and a forth pairs of conductive contacts respectively to form the third and the forth signal channels, said plurality of conductive contacts being arrayed in a line, eight conductive contacts of the four pairs being listed in turn the first to eighth conductive contacts, the first and the second conductive contacts composing the first pair, the third and the sixth composing the second pair, the forth and the fifth composing the third pair, and the seventh and the eight composing the forth pair.

5. The electrical connector according to claim 4, wherein the first capacitive plate is electrically connected to the third conductive contact, the electrical connector further comprising a second capacitive plate electrically connecting the fifth conductive contact and disposed closer to third conductive contact, a third capacitive plate electrical connecting the forth conductive contact and disposed closer to the sixth conductive contact, and a forth capacitive plate electrical connecting the sixth conductive contact and disposed closer to the eighth conductive contact.

6. The electrical connector according to claim 5, wherein the insulator is partially hollowed out between the second capacitive plate and the third conductive contact, the third capacitive plate and the sixth conductive contacts, the forth capacitive plate and the eighth conductive contact.

7. The electrical connector according to claim 5, wherein each of the conductive contacts forming a fastening portion received in the insulator for fastening the conductive contact therein, a contacting portion extending from an end of the fastening portion for contacting the complementary connector and a tail portion extending from an opposite end of the fastening portion for electrically connecting a printed circuit board.

8. The electrical connector according to claim 6, wherein the first to the eighth conductive contacts are stamped from a carrier plate, the third to the sixth conductive contacts each defines a through hole for receiving a pin extending from each of the first to the forth capacitive plate.

9. An electrical connector comprising:

first and second contacts commonly defining a first differential pair to form a first signal channel, and third and fourth contacts commonly defining a second differential pair to form a second signal channel, the first differential pair and the second differential pair being side by side arranged with each other in one plane under condition of the first, second, third and fourth contacts being disposed in sequence with the second contact and the third contact being neighboring to each other; and a capacitive plate defining a main region located in another plane different from said plane defined by said first and second differential pairs, and a connection end extending to said plane, wherein the main region is located vertically closer to one of said four contacts than others, and the connection end is connected to another one of said four contacts which is not neighboring to said one of said four contacts but being spaced from said one of the four contacts with only one of said four contacts therebetween; wherein an insulator is disposed between the two planes and defines a hole through which the connection end extends from the another plane to the plane; and wherein the insulator defines another through hole for improvement of crosstalk between the first and second signal channels.

10. The electrical connector as claimed in claim 9, wherein said main region is closer to said first contact than to said second, third and fourth contacts.

11. The electrical connector as claimed in claim 10, wherein said main region is vertically aligned with said first contact essentially.

* * * * *